United States Patent [19]

Selden

[11] 4,102,065

[45] Jul. 25, 1978

[54] ADJUSTABLE STAND FOR NEEDLEWORK AND THE LIKE

[75] Inventor: Boynton Selden, West Hartford, Conn.

[73] Assignee: Michele R. Selden, Trustee, West Hartford, Conn.

[21] Appl. No.: 796,859

[22] Filed: May 16, 1977

[51] Int. Cl.[2] ..... D05C 1/02; D06C 3/08

[52] U.S. Cl. ..... 38/102.1; 28/149; 108/43; 248/122; 248/125

[58] Field of Search ..... 28/149, 151, 152; 248/441, 122, 125; 289/18; 38/102.1, 102.2, 102.4; 108/43

[56] References Cited

U.S. PATENT DOCUMENTS

| | | | |
|---|---|---|---|
| 647,807 | 4/1900 | Collins | 108/43 |
| 1,077,211 | 10/1913 | Alt Fuldisch | 38/102.4 |
| 1,531,540 | 3/1925 | Calero | 248/441 |
| 2,795,031 | 6/1957 | Gierling et al. | 28/149 |
| 3,116,568 | 1/1964 | Morrison et al. | 248/441 |
| 3,621,541 | 11/1971 | Watkins | 28/149 |
| 3,774,325 | 11/1973 | Johnson et al. | 38/102.2 |
| 3,906,648 | 9/1975 | Bard | 108/43 |
| 3,938,267 | 2/1976 | Bard | 38/102.1 |

FOREIGN PATENT DOCUMENTS

| | | | |
|---|---|---|---|
| 632,003 | 12/1961 | Canada | 28/149 |
| 868,254 | 5/1961 | United Kingdom | 28/149 |

*Primary Examiner*—Louis K. Rimrodt

[57] ABSTRACT

A collapsible and adjustable stand for supporting needlework and the like includes base members, vertical leg members secured to the base members, and a support member pivotally secured to the upper end of the vertical leg members. The support member is pivotable into a plurality of angular positions relative to the vertical leg members and is retained in pivotally adjusted position by angular adjustment means. The stand includes bracing means to increase the stability of the structure. The support member includes two spaced end elements which define the angularly adjustable plane thereof and may include one or more elongated bar members extending between the ends thereof. A multiplicity of upwardly projecting pins on alternate forms of the support member serve either to define a recess for seating a needlepoint frame and to retain lengths of wool or the like for use therewith, or to provide means for seating thereon the canvas of a rug being worked upon.

10 Claims, 4 Drawing Figures

ADJUSTABLE STAND FOR NEEDLEWORK AND THE LIKE

BACKGROUND OF THE INVENTION

Of recent years, there has been considerable growth in interest in various forms of needlework both as a form of relaxation and as a means of creating attractive works of art for aesthetic purposes. Needlepoint and rug hooking have, in many instances, involved relatively large workpieces requiring support in a manner so as to facilitate work above and below the underlying canvas or material. With the increase in size of the workpieces, it has become more essential to provide convenient and adjustable means for supporting the work in front of the user in a manner permitting ready access to both surfaces thereof because of the problems attendant in attempting to lift or move the work repeatedly.

For example, a loom is shown in Clack U.S. Pat. No. 2,582,008 and a rug weaving frame is shown in Meyer U.S. Pat. No. 2,273,446. Work tables for rug hooking are shown in Wilder U.S. Pat. No. 2,691,203 and Watkins U.S. Pat. No. 3,621,541; and a quilting frame is shown in Meyer et al U.S. Pat. No. 2,318,877.

As will be appreciated, devices of the type shown in the several patents are especially adapted for only one type of needleworking activity and do not permit facile and rigid angular adjustment.

It is an object of of the present invention to provide a novel, collapsible and adjustable stand for supporting needlework and the like which permits facile and rigid vertical adjustment of the plane of the work.

It is also an object to provide such a stand which, by simple interchange of parts, may be utilized for supporting needlepoint frames, or for rug hooking or the like.

Another object is to provide such a stand in which the elements may be readily assembled and disassembled and which may be fabricated economically and quickly from elements of simple configuration and rugged material.

SUMMARY OF THE INVENTION

It has now been found that the foregoing and related objects can be readily attained in a collapsible and adjustable stand which includes a pair of horizontally spaced base members, a pair of horizontally spaced vertical leg members and disengageable fastening means securing the lower ends of the vertical leg members to the base members. At the upper end of the vertical leg members is a support member including a pair of elongated horizontally spaced end elements which define the plane of the work, and detachable fastening means which pivotally mount the end elements upon the upper end portions of the vertical leg members. In addition, the support member includes a multiplicity of spaced upwardly projecting pins.

Angular adjustment means to maintain the support member in any one of a multiplicity of angularly pivoted positions includes strut members extending upwardly from the vertical leg members to the end elements of the support member, and the strut members and end elements have cooperating means which permit engagement of the upper end portions of the strut members at each of a multiplicity of points spaced along the length of the end elements. Detachable fastening means pivotally secure the lower end portions of the strut members to the vertical leg members so as to permit pivoting of the strut members into a multiplicity of angular positions relative to the leg members. The stand also includes bracing means extending between the vertical leg members intermediate the length thereof and which essentially comprises an elongated brace member extending between the vertical members and detachable fastening means securing the brace member to the vertical leg members.

In one embodiment of the stand, the support member has projecting pins located at least at the end portions of the end elements and these pins cooperate to define a recess to removable seat therebetween a frame for needlepoint or the like extending therebetween. The support member may additionally include an elongated bar extending between one end portion of the end elements, and upwardly extending pins may seat in downwardly opening apertures in the elongated bar to effect assembly thereof. The elongated bar in turn may have a multiplicity of upwardly projecting pins thereon for supporting lengths of yarn and the like.

In another embodiment of the stand, the support member additionally includes a pair of elongated bar elements extending between the end portions of the end elements and detachable fastening means securing the elongated bar elements to the end elements. In this embodiment, upwardly projecting pins are desirably spaced along the length of the bar element spaced from said strut members of the angular adjustment means, with such pins being adapted to project through the canvas or other fabric workpiece to maintain it seated thereupon.

Desirably, the bracing means includes strut members which extend diagonally between the vertical leg members and the elongated brace member, and detachable fastening means to secure the strut members to the vertical leg members and to the brace member. The cooperating means of the angular adjustment means comprises a multiplicity of notches spaced along the lower surface of the end elements and end portions on the strut elements which seat within the notches.

In a preferred embodiment, the vertical leg members are engageable with the brace member of the bracing means at a multiplicity of points along its length so as to vary the horizontal spacing between the vertical leg members and thereby the horizontal spacing between the end elements of the support member.

BRIEF DESCRIPTION OF THE DRAWINGS

FIG. 1 is a perspective view of a collapsible and adjustable stand embodying the present invention showing a support member especially adapted for supporting a needlepoint frame or the like;

FIG. 2 is a fragmentary perspective view of the stand showing an alternate support member of the type for supporting a canvas or other workpiece for rug hooking or the like;

DETAILED DESCRIPTION OF THE ILLUSTRATED EMBODIMENTS

Figure 1:
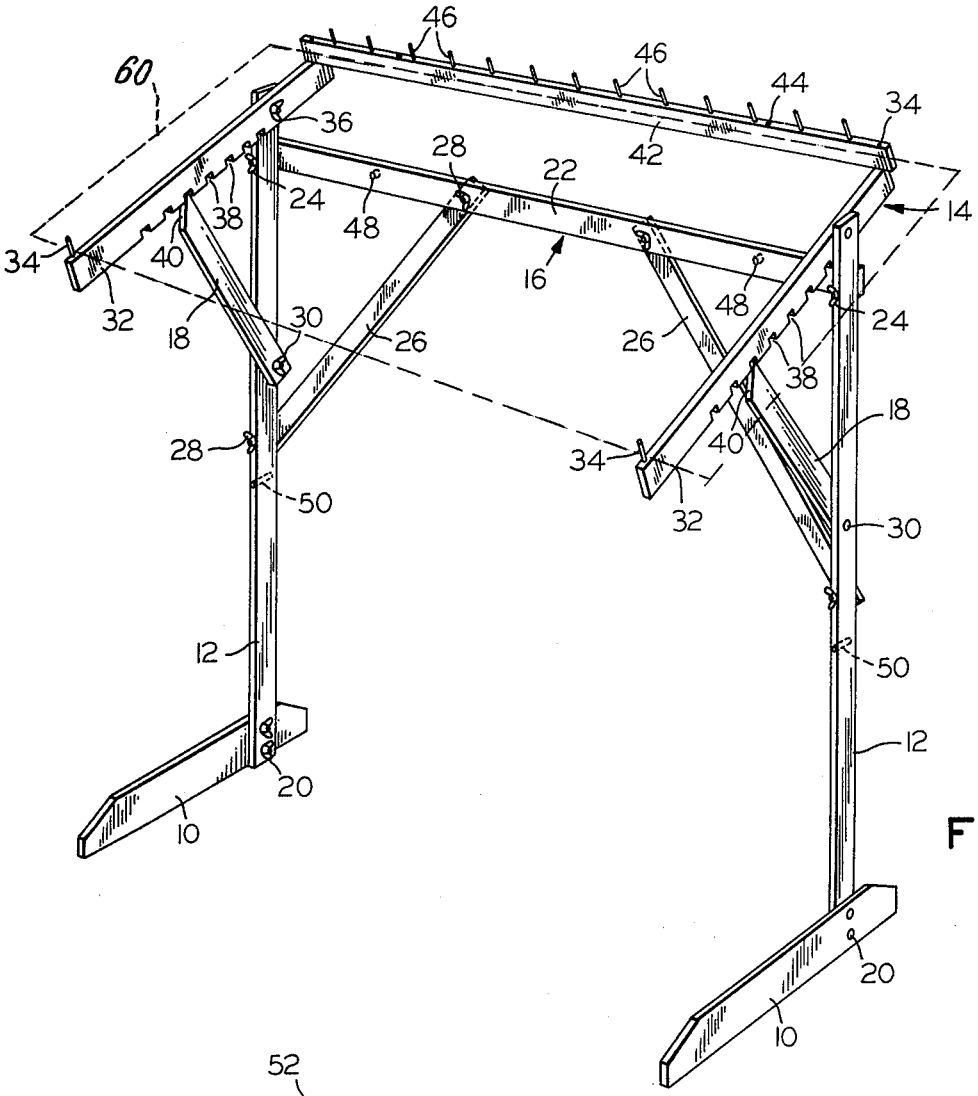
Figure 3:
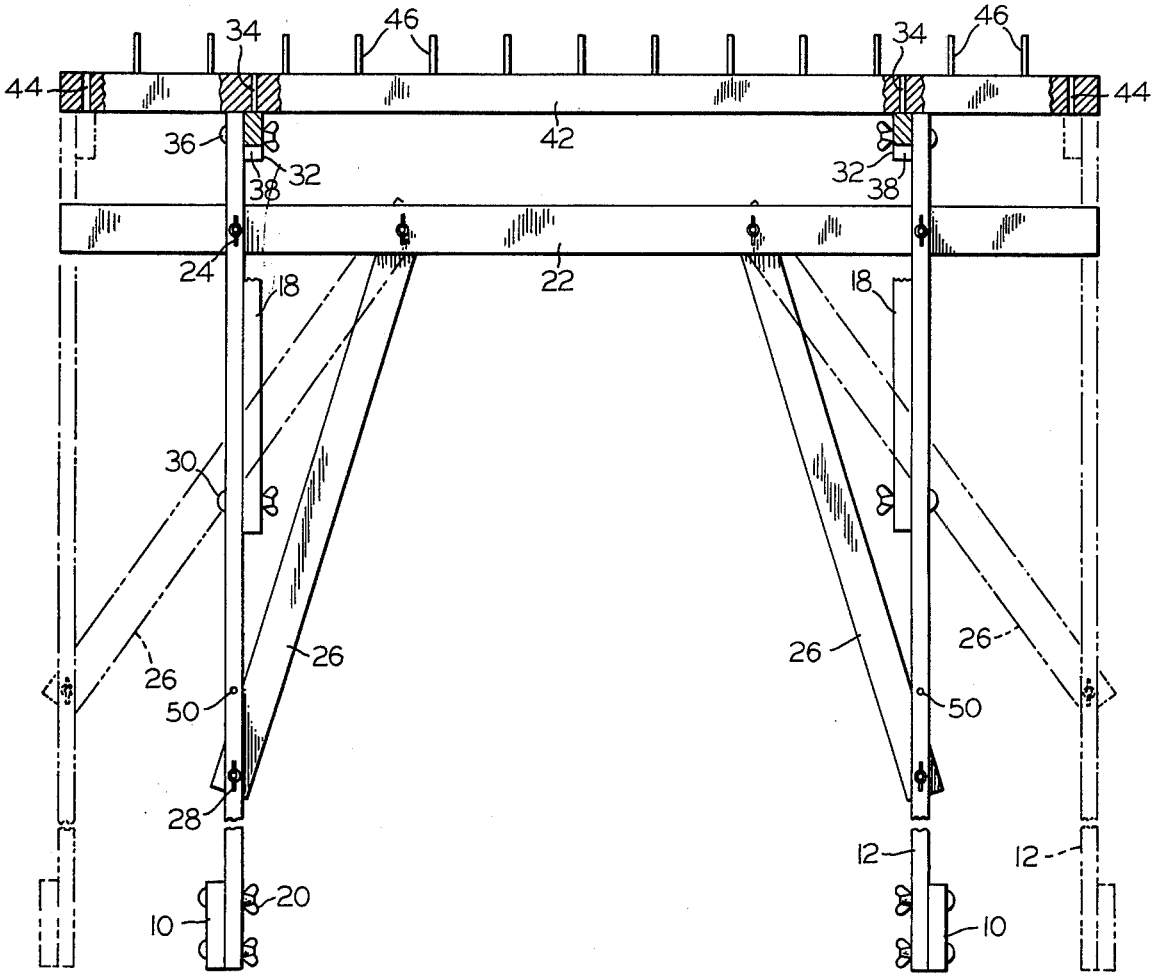
FIG. 3 is a rear elevational view of the stand of FIG. 1 showing the vertical leg members in full line as assembled to provide a reduced space between the end elements of the support member, and the vertical leg members in phantom line to show the fully extended position of FIG. 1.
Figure 4:
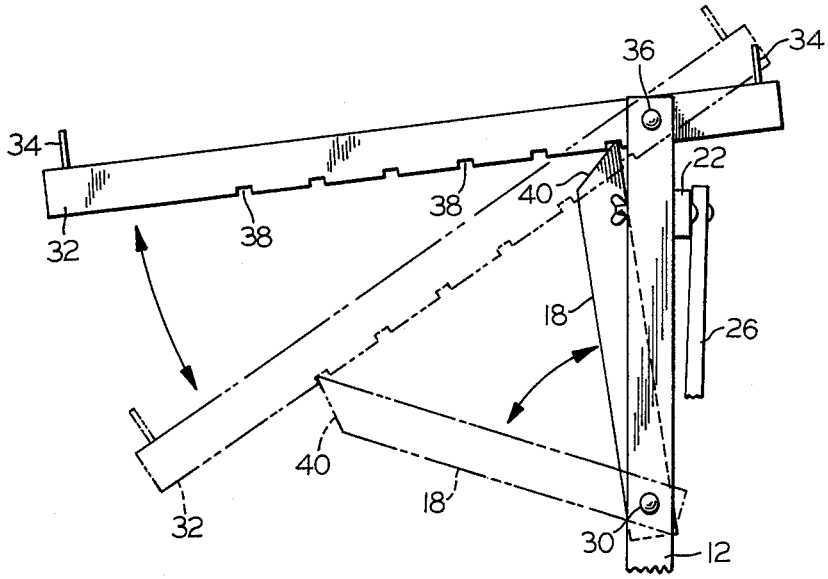
FIG. 4 is a fragmentary side elevational view to an enlarged scale of the stand of FIG. 1 showing the support member and adjustable strut in full line as disposed to provide a work plane approaching the horizontal and showing in phantom line the support member and adjustable strut as disposed to provide a work plane of increased angularity.

Turning first to FIGS. 1, 3 and 4 of the attached drawings, therein illustrated is an adjustable and disassemblable stand embodying the present invention wherein the support member elements are of the type conveniently employed for needlepoint and the like to support a frame (not shown. The stand includes a pair of horizontally spaced elongated base members 10, horizontally spaced vertical leg members 12, a support member generally designated by the numeral 14 and bracing means generally designated by the numeral 16. The support member 14 is held in angularly adjusted positions by the angular adjustment struts 18 as will be more fully described hereinafter.

As best seen in FIG. 3, the vertical leg members 12 are secured at their lower ends to the base members 10 at a point spaced towards one end thereof by means of the fasteners 20 which are elongated machine screws and wing nuts. The rigidity and stability of the structure is enhanced by the bracing assembly 16 which essentially includes the elongated brace member 22 which is secured at its ends to the vertical leg members 12 by similar fasteners 24. Diagonal strusts 26 extend upwardly and inwardly from the vertical leg members 12 to the elongated brace member 22 and are secured thereto by fasteners 28. The angular adjustment struts 18 in turn are rigidly secured at their lower ends to the vertical leg members by the fasteners 30.

In this embodiment, the support member 14 includes a pair of elongated end elements 32 having upwardly projecting pins 34 at either end thereof and which are pivotally mounted at a point spaced towards one end upon the upper end portions of the vertical leg members 12 by the fasteners 36. As can be seen, the end elements 32 have a multiplicity of notches 38 spaced along the lower surface of one end portion thereof and which seat the bevelled end portion 40 of the adjustment strut 18. In the illustrated embodiment, the support member 14 includes an elongated bar 42 extending between the end elements 32 and having apertures 44 therein to receive the pins 34 to effect engagement therebetween. Additionally, the elongated bar 42 includes a multiplicity of upwardly projecting pins 46 which are adapted to support lengths of yarn or the like. In this embodiment, it can be seen that the pins 34 and the elongated bar 42 define a recess in which may be seated a needlepoint frame 60; however, the elongated bar member 42 may be omitted and the seating recess defined solely by the upwardly projecting pins 34 on both ends of the end elements 32. The plane of the needlepoint frame may be adjusted relative to the horizontal by pivoting the support member 14 about the fasteners 36 and securing it into the pivoted position by engagement of the adjustment struts 18 in the corresponding notches 38.

When it is desired to reduce the spacing between the end elements 32 so as to support a shorter needlepoint frame, the vertical leg members 12 may be moved inwardly and the fasteners 24 secured in the apertures 48. Concurrently, the lower or outer ends of the struts 26 of the bracing assembly 16 are moved downwardly and the screws 28 are seated in the apertures 50 of the vertical leg members 12, all as clearly shown in FIG. 3.

Figure 2:
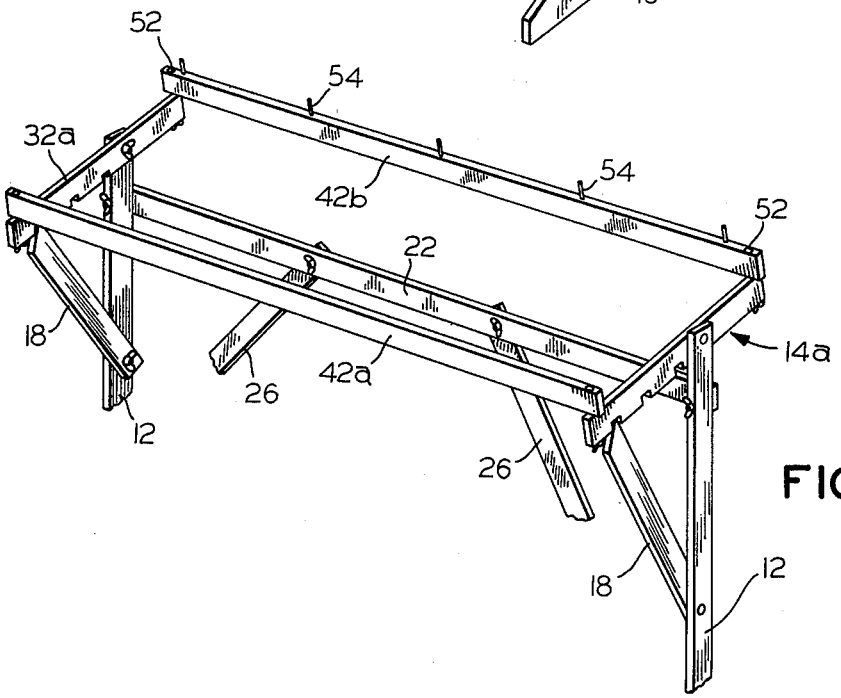

In the embodiment of FIG. 2, there is shown a support member **14*a* of the type especially adapted for rug hooking and the like. In this embodiment, the end elements 32*a* do not have upwardly projecting pins at the ends thereof but are provided with apertures (not shown) extending therethrough. A pair of elongated bar members 42*a*, 42*b* are disposed upon the end portions of the end elements and secured thereto by the fasteners 52. The rearward bar 42*b* has a multiplicity of upwardly projecting pins 54** spaced along the length thereof adapted to extend through canvas or other fabric supported upon the stand for rug hooking and the like.

In either of the illustrated embodiments, it will be appreciated that all of the components may be readily disassembled since the fastening means permit facile disassembly. However, when combined and assembled, the stand provides a relatively rigid and adjustable support for the work and the plane of the work may be adjusted by the user to provide the most convenient access to the work surface. Moreover, if so desired, the diagonal adjustment struts may be disengaged entirely from the support member which may be then pivoted into a substantiallly vertical plane for purposes of displaying the work thereon.

It will be appreciated that the vertical leg members may be adjustable in height by making such members in two pieces and securing the two pieces together by disengageable fasteners. Alternatively, several vertically spaced apertures for seating the pivotal fastening means for the support member may be provided in the upper end portion of the legs to lower its vertical spacing relative to the floor or to the surface upon which the stand is supported.

It will be readily appreciated that the several components may be fabricated of wood, plastic, metal or any other suitable material providing the desired degree of strength commensurate with the desired light weight and portability. The upstanding pins are conveniently provided by wood dowels finished to the requisite degree of smoothness, although metal pins and the like may also be employed. Obviously, fasteners other than the machine screws and wing nuts may be utilized if desired to provide the disengageable fastening means, but wing nuts do afford the opportunity for simple finger assembly and adjustment.

From the foregoing detailed specification and drawings, it can be seen that the stand of the present invention is one which is adjustable, disassemblable and rugged. It permits utilization for a number of needleworking activities and may be fabricated readily from economical and durable components.

Having thus described the invention, I claim:

1. A collapsible and adjustable stand for supporting needlework and the like comprising:

A. a pair of horizontally spaced base members;

B. a pair of horizontally spaced vertical leg members;

C. disengageable fastening means securing the lower ends of said vertical leg members to said base members with said base members extending in parallel spaced relationship and adapted to support the stand upon a floor or like surface and with said leg members extending vertically upwardly therefrom in spaced parallel relationship;

D. needlework support means including:

(1) a pair of elongated horizontally spaced end elements extending parallel to said base members and adjacent the upper ends of said vertical leg members;

(2) a multiplicity of spaced upwardly projecting pins on said support means to retain the associated needlework on said support means;

E. detachable fastening means pivotally mounting said end elements of said needlework support means upon the upper end portions of said vertical leg members;

F. angular adjustment means for said support means including:

(1) strut members extending upwardly from said vertical leg members to said end elements of said support means, said strut members and end elements having cooperating means permitting engagement of the upper end portions of said strut members at each of a multiplicity of points spaced along the length of said end elements; and (2) detachable fastening means pivotally securing the lower end portions of said strut members to said vertical leg members, whereby said support means may be adjusted into a multiplicity of angularly pivoted positions relative to said leg members; and G. bracing means extending between said vertical leg members intermediate the length thereof and including:

(1) an enlongated brace member extending between said vertical members intermediate the length thereof; and (2) detachable fastening means securing said brace member to said vertical leg members.

2. The stand in accordance with claim 1 wherein said support means has said projecting pins located at least at both of the end portions of each of said end elements cooperating to define therebetween an enclosure to removably seat therebetween a frame for needlepoint or the like extending between said end elements.

3. The stand in accordance with claim 2 wherein said support means additionally includes an elongated bar extending between the end portions of said end elements spaced from said strut members of said angular adjustment means, said upwardly projecting pins on said end elements removably seating in downwardly opening apertures in said elongated bar, said elongated bar having a multiplicity of upwardly projecting pins thereon for supporting lengths of yarn and the like.

4. The stand in accordance with claim 1 wherein said support means additionally includes a pair of elongated bar elements extending between the end portions of said end elements and detachable fastening means securing said elongated bar elements to said end elements with said upwardly projecting pins being spaced along the length of the bar element spaced from said strut members of said angular adjustment means.

5. The stand in accordance with claim 1 wherein said bracing means includes strut members extending diagonally between said vertical leg members and said elongated brace member and detachable fastening means securing said strut members to said vertical leg members and said brace member.

6. The stand in accordance with claim 1 wherein said cooperating means of said angular adjustment means comprises a multiplicity of notches spaced along the lower surface of said end elements and end portions on said strut members seating within said notches.

7. The stand in accordance with claim 1 wherein said vertical leg members are engageable with said brace member of said bracing means at a multiplicity of points to vary the horizontal spacing between said vertical leg member.

8. A collapsible and adjustable stand for supporting needlework and the like comprising:

A. a pair of horizontally spaced base members;

B. a pair of horizontally spaced vertical leg members;

C. disengageable fastening means securing the lower ends of said vertical leg members to said base members with said base members extending in parallel spaced relationship and adapted to support the stand upon a floor or like surface and with said leg members extending vertically upwardly therefrom in spaced parallel relationship;

D. a needlework support member comprised of a pair of elongated horizontally spaced end elements extending parallel to said base members and adjacent the upper ends of said vertical leg members, said end elements having upwardly projecting pins on the end portions thereof cooperating to define therebetween an enclosure to removably seat therebetween a frame for needlepoint or the like extending between said end elements;

E. detachable fastening means pivotally mounting said end elements upon the upper end portions of said vertical leg members;

F. angular adjustment means for said support member including:

(1) strut members extending upwardly from said vertical leg members to said end elements of said support member, said strut members and end elements having cooperating means permitting engagement of the upper end portions of said strut members at each of a multiplicity of points spaced along the length of said end elements; and (2) detachable fastening means pivotally securing the lower end portions of said strut members to said vertical leg members, whereby the support member may be adjusted into a multiplicity of angularly pivoted positions relative to said leg members; and G. bracing means extending between said vertical leg members intermediate the length thereof and including:

(1) an elongated brace member extending between said vertical members intermediate the length thereof; and (2) detachable fastening means securing said brace member to said vertical leg members.

9. The stand in accordance with claim 8 wherein said support member additionally includes an elongated bar extending between the end portions of said end elements spaced from said strut members of said angular adjustment means, said upwardly projecting pins on said elements removably seating in downwardly extending apertures in said elongated bar, said elongated bar having a multiplicity of upwardly projecting pins thereon for supporting lengths of yarn and the like.

10. A collapsible and adjustable stand for supporting needlework and the like comprising:

A. a pair of horizontally spaced base members;

B. a pair of horizontally spaced vertical leg members;

C. disengageable fastening means securing the lower ends of said vertical leg members to said base members with said base members extending in parallel spaced relationship and adapted to support the stand upon a floor or like surface and with said leg members extending vertically upwardly therefrom in spaced parallel relationship;

D. a support member including:

(1) a pair of elongated horizontally spaced end elements extending parallel to said base members and adjacent the upper ends of said vertical leg members;

(2) a pair of elongated bar elements extending between the end portions of said end elements;

(3) upwardly projecting pins spaced along the length of one of the elongated bar elements; and (4) detachable fastening means securing said elongated bar elements to said end elements, whereby the needlework may be secured by said upwardly projecting pins and supported upon said elongated bar elements;

E. detachable fastening means pivotally mounting said end elements upon the upper end portions of said vertical leg members;

F. angular adjustment means for said support member including:

(1) strut members extending upwardly from said vertical leg members to said end elements of said support member, said strut members and end elements having cooperating means permitting engagement of the upper end portions of said strut members at each of a multiplicity of points spaced along the length of said end elements; and (2) detachable fastening means pivotally securing the lower end portions of said strut members to said vertical leg members, whereby the support member may be adjusted into a multiplicity of angularly pivoted positions relative to said leg members; and G. bracing means extending between said vertical leg members intermediate the length thereof and including:

(1) an elongated brace member extending between said vertical members intermediate the length thereof; and (2) detachable fastening means securing said brace member to said vertical leg members.

* * * * *